US009066560B2

(12) United States Patent
Rodriguez

(10) Patent No.: US 9,066,560 B2
(45) Date of Patent: Jun. 30, 2015

(54) SKATE SHOELACE PROTECTION STRUCTURE HAVING A CONTINUOUS SLIDING UPPER INTERFACE

(71) Applicant: Maurice Rodriguez, Grand Prairie, TX (US)

(72) Inventor: Maurice Rodriguez, Grand Prairie, TX (US)

( * ) Notice: Subject to any disclaimer, the term of this patent is extended or adjusted under 35 U.S.C. 154(b) by 285 days.

(21) Appl. No.: 13/763,958

(22) Filed: Feb. 11, 2013

(65) Prior Publication Data

US 2014/0082962 A1 Mar. 27, 2014

Related U.S. Application Data

(60) Provisional application No. 61/706,063, filed on Sep. 26, 2012.

(51) Int. Cl.

| | |
|---|---|
| ***A43B 23/26*** | (2006.01) |
| ***A43C 7/00*** | (2006.01) |
| ***A43B 1/00*** | (2006.01) |
| ***A43C 11/14*** | (2006.01) |

(52) U.S. Cl.

CPC ..... *A43C 7/00* (2013.01); *A43B 1/0081* (2013.01); *A43C 7/005* (2013.01); *A43C 11/1493* (2013.01)

(58) Field of Classification Search

USPC ..... 36/54, 50.1, 136

See application file for complete search history.

(56) References Cited

U.S. PATENT DOCUMENTS

| | | | | |
|---|---|---|---|---|
| 4,065,861 | A * | 1/1978 | Pelfrey | 36/133 |
| 4,079,527 | A * | 3/1978 | Antonious | 36/51 |
| 4,114,297 | A * | 9/1978 | Famolare, Jr. | 36/50.1 |
| 4,377,913 | A | 3/1983 | Stone | |
| 5,459,947 | A | 10/1995 | Lasher | |
| 6,408,542 | B1 * | 6/2002 | Shepherd | 36/54 |
| 6,895,696 | B1 | 5/2005 | Sanders | |
| 7,392,603 | B1 * | 7/2008 | Shepherd et al. | 36/54 |
| 2002/0029496 | A1 * | 3/2002 | Morle | 36/99 |
| 2002/0092142 | A1 | 7/2002 | Schoen | |
| 2002/0170205 | A1 | 11/2002 | Shepherd | |
| 2005/0235525 | A1 * | 10/2005 | Jacobs | 36/50.1 |
| 2006/0075614 | A1 | 4/2006 | Chmelar | |
| 2007/0261269 | A1 * | 11/2007 | Petrie | 36/50.1 |
| 2008/0078103 | A1 * | 4/2008 | Liles | 36/50.1 |

* cited by examiner

*Primary Examiner* — Marie Bays

(74) *Attorney, Agent, or Firm* — Daniel Boudwin; Global Intellectual Property Agency LLC

(57) ABSTRACT

A skate shoe is disclosed having a shoe sole, a shoe upper, and a protective cover over the shoe upper shoelaces to prevent premature wear and failure thereof, while offering a smooth sliding interface across the shoe upper for skating activities. The shoelace cover comprises an inner tongue and outer tongue sandwiching the shoelaces therebetween, while the shoe upper terminates above the outer tongue and a lateral strap secures over the assembly. The strap originates from the outside portion of the shoe upper and is secured along the shoe upper interior portion, offering an interface across the strap and the secured outer tongue enclosed within the shoe upper that is adept at sliding along a skateboard griptape without having discontinuities and exposing the shoelaces to contact with the skateboard. The inner and outer tongue pivot from the shoe throat line and secure at their distal ends when in use.

3 Claims, 2 Drawing Sheets

SKATE SHOELACE PROTECTION STRUCTURE HAVING A CONTINUOUS SLIDING UPPER INTERFACE

CROSS REFERENCE TO RELATED APPLICATION

This application claims the benefit of U.S. Provisional Application No. 61/706,063 filed on Sep. 26, 2012, entitled "Sypherz." The above identified patent application is herein incorporated by reference in its entirety to provide continuity of disclosure.

BACKGROUND OF THE INVENTION

1. Field of the Invention

The present invention relates to skateboarding equipment and footwear articles. More specifically, the present invention pertains to a skateboarding footwear article having a protective guard forming over the footwear upper region and over the shoe tie laces to afford protection and lace failure during skating activities.

Skateboarding shoes are a cross between athletic footwear and fashionable apparel that provide a skateboarder with stable footing, traction on the skateboard and on the ground, and afford the skateboarder comfort and style while donned. Most skateboarding shoes include a soft rubber or polyurethane sole that wears gradually but provides long-term comfort for the wearer. The shoe upper is usually a low cut design comprised of a suede or leather upper having reinforced construction and stitching to ensure the integrity of the shoe over an extended period of use and abuse while skateboarding. Most skate shoes include woven laces across an enlarged and padded tongue, whereby the tongue protects the top of the wearer's feet while the laces keep the footwear attached to the wearer during skateboarding tricks and while in motion.

A common problem in the art of skate shoes is the tendency of the shoe laces to become quickly worn. The laces become abraded and begin to fray much quicker than with traditional footwear based on the skateboarding activity, which often entails tricks or stunts that require the skateboarder to drag his or her feet along the surfaces of the board when transitioning foot position therealong. More specifically, the common skateboarding trick known as the "Ollie" is a maneuver that allows the user to jump over objects and over gaps in the ground while in control of the board and without grabbing the board by hand. The user flips the base of the board such that its back end contacts the ground while its front end lifts rapidly upwards. The boarder jumps with the skateboard as the board rebounds off of the ground to allow both the board and the skater to become airborne. During this activity, the user drags the top of his or her front foot along the board upper surface to regain control over the board. The upper surface is known as the griptape, which comprises a high friction, abrasive surface for traction. As the user's foot upper is drug along the board, the griptape abrades and damages the wearer's laces, causing rapid fraying and deterioration thereto.

To combat this aggressive wearing and premature failure of skate shoe laces, various fixes have been implemented. However most of these are limited to treatments to the actually laces and not directed to preventing the abrasive contact to begin with. The present invention pertains to a new skate shoe having a laces cover that is operably connected thereover and then secured using a secondary strap. The woven laces that a fed through the eyelets of the shoe upper are protected from direct contact with the griptape surface of a skateboard, while the user has the option of deploying the laces knot under or over the secured cover for access or for aesthetic purposes. The sole and upper of the shoe may be comprised of known and readily available skate shoe materials commonly found in the art, while the exact design and shape of the shoe may be designed for specific styles to suit different users. Overall, the present invention provides a laces guard for skate shoes that reduces premature failure of the underlying laces.

2. Description of the Prior Art

Devices have been disclosed in the prior art that relate to shoe accessories and attachments that afford protection for a set of shoe laces. These include devices that have been patented and published in patent application publications, and generally relate to specific designs for athletic footwear that prevent interference of the laces with the athlete's feet or provide a decorative cover thereover. Most relate to cylindrical covers that fit over the length of the laces, while others relate to a cover over the woven laces on the footwear article. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,459,947 to Lasher discloses a decorative attachment for a lace-up style shoe, wherein the attachment comprises a tapering material having a lace cover portion and an extension portion. The extension portion is fed under the laces of a shoe and above the shoe tongue, while the cover portion is folded upwards over the laces of the shoe and connected to the underlying extension portion by a hook and loop fastening means. The device conceals the shoe tongue and lace region from view while providing outward indicia of the user's choosing. The Lasher device is one that is separable from the shoe and is an attachment therefor. The present invention contemplates a new skateboarding shoe having both support and shoe lace protection to prevent unwanted wear and reduced useful life.

U.S. Pat. No. 6,895,696 to Sanders discloses an article of footwear having a tongue region that includes an inner compartment. The compartment opening is along an upper edge of the tongue towards the tied laces of the show, wherein the compartment can be sealed to protect stored items inside. The compartment is designed to act as a pocket for the loose shoe string ends of the knot, preventing them from tangling with the user's feet or become damaged from abrasion with outside objects. The compartment also provides storage for keys, identification, and money for a user engaging in an activity without alternative means for storage. Overall, however, the Sanders device provides no protection for the outer laces of the shoe during activities, as is the intention of the present invention.

U.S. Pat. No. 4,377,913 to Stone discloses a double tongue shoe assembly that is adapted for those aged or very young persons who have difficulty securing shoe laces, buckles, or shoe straps of conventional shoes. The assembly comprises a shoe having an inner tongue, an outer tongue, and hook and loop fasteners that secure the outer and inner tongue along their edges to the vamp region of the shoe. The vamp includes a throat that opens to accept a user's foot, whereafter the tongues secure the throat into a closed position without the support of a laces or strap system. The Stone device, while comprises a securable tongue along the outer portion of the footwear article, does not provide sufficient stability of the user's foot to engage in skateboarding activities. Specifically, the shoe includes no underlying lacing structure to ensure the shoe stays firmly in place during use, and is more directed to those having difficulty donning conventional shoe structures.

U.S. Patent Application Publication No. 2002/0170205 to Shepherd discloses a padded shoe having a shoe upper adjoined to a sole, and padding material disposed along the shoe upper at the forward dorsal region, the left and right lateral aspects, and the tongue region. The padded tongue region includes and inner and outer tongue portion, a hinged connection of the outer tongue at its base, and fastening structure between the inner and outer tongue to secure the two together during activity. The Shepherd device, while disclosing a footwear article having an outer tongue portion, fails to disclose a skate shoe having the structure of the present invention. The present invention provides a skate shoe having a pivotable outer tongue region and a securing strap thereover to protect the woven laces within the shoe upper from wear during skating activities.

Overall, the present invention provides a new and improved skate shoe that protects the lacing structure of the shoe from repeated wear during skating tricks, increasing the longevity of the laces and preventing premature replacement thereof. The structure is adapted to shroud the laces while also provide a smooth interface for which to the wearer to drag his or her shoe upper against a skate griptape without worrying about wear to the laces or to the structure of the shoe. The function of the skate shoe is retained, while the design provides a unique style and specific functionality. It is submitted that he present invention is substantially divergent in design elements from the prior art, and consequently it is clear that there is a need in the art for an improvement to existing skate shoe devices. In this regard the instant invention substantially fulfills these needs.

SUMMARY OF THE INVENTION

In view of the foregoing disadvantages inherent in the known types of skate shoes now present in the prior art, the present invention provides a new and improved skate shoe having an upper covering to protect its shoe laces, wherein the same can be utilized for providing convenience for the user when engaging in skateboarding activities without exposing their footwear to excessive shoe lace wear that requires premature replacement thereof.

It is therefore an object of the present invention to provide a new and improved skate shoe device that has all of the advantages of the prior art and none of the disadvantages.

It is another object of the present invention to provide a new skate board shoe the protects the laces woven within the shoe upper region, whereby the laces are shrouded to prevent wear caused by normal skateboarding activity and tricks that introduce the laces to external contact.

Another object of the present invention is to provide a new skate board shoe that comprises a first and second tongue structure sandwiching an arrangement of woven laces that draw together the open upper region of the shoe, whereby the first and second tongues secure together over the laces to provide an outer surface barrier that prevents sliding contact that would otherwise abrade and wear the woven laces.

Yet another object of the present invention is to provide a new skate board shoe that comprises a secondary strap extending across the shoe upper in a lateral direction, securing over the second (outermost) tongue to provide securement thereof such that the outer tongue does not dislodge based on sliding contact with a skateboard during use.

Another object of the present invention is to provide a new skate board shoe that offers a smooth interface along the shoe upper when secured, whereby the outermost strap connects from the outside and is secured along the inner portion of the shoe to allow a user to drag his or her foot upper against a skateboard without lifting and separating the strap or the outermost tongue.

A final object of the present invention is to provide a new skate board shoe having a low top or high top configuration and comprising construction and material commonly found in skate shoes in the art.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
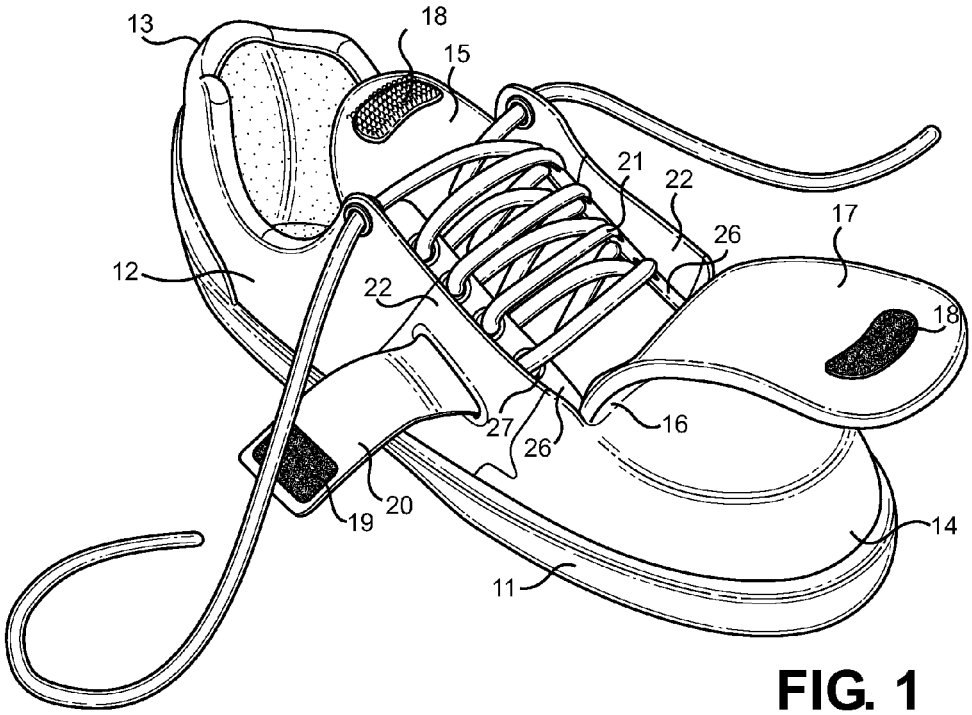
FIG. 1 is an overhead perspective view of the present invention in an open configuration, highlighting the structural elements of the device.

Reference is made herein to the attached drawings. Like reference numerals are used throughout the drawings to depict like or similar elements of the skate shoe. For the purposes of presenting a brief and clear description of the present invention, the preferred embodiment will be discussed as used for protecting the woven shoelaces within the shoe upper during skateboarding activities and providing a clean interface for a skateboard to slide thereacross without fear of the assembly becoming detached or opening while donned. The figures are intended for representative purposes only and should not be considered to be limiting in any respect.

Referring now to FIG. 1, there is shown an overhead perspective view of the skate shoe of the present invention in an open position. The shoe comprises a sole portion 11 having a deformable and supportive structure that provides secure footing and traction during skating activities. The sole 11 is secured to the shoe upper 12 that includes a toe portion 14 and a heel portion 13. An opening accepts a user's foot therein, while an open throat portion incorporates a woven shoelace structure 21 that secures the shoe upper over the user's foot. This configuration is well known in the art of shoes and in skate shoes. The present invention advances the art by providing an inner tongue 15 and an outer tongue 17 that sandwiches over the shoelaces 21 to form a protective cover therefor. An upper edge 22 of the shoe upper forms over the outer tongue 17 when secured over the laces 17 to provide a smooth transition between the shoe upper and the tongue 17. Finally, a lateral strap 20 is provided that secures over the outer tongue 17 when sandwiching the laces 21 to ensure the inner and outer tongue remain connected and the assembly stays securely intact during use.

The inner 18 and outer tongue 17 are elongated members that secure at their base end to the shoe upper throat line 16 and are pivotable therefrom. The tongues secure together over the shoelaces 21 by way of a connector element 18 along each tongue's distal end, whereby the tongues are separable and pivotable from the throat line 16 and thereafter securable together over the laces 21 to prevent abrasion thereto while skating. Similarly, the strap member 20 comprises a base and a distal end, the base being secured along the outer portion of the shoe upper and forming over the topside of the outer tongue 17 towards the inner portion of the shoe upper. A strap connector element 19 provides connection of the strap distal end to the shoe upper inner portion to prevent the outer tongue 17 from becoming dislodged.

The orientation of the strap and its base being connected along the outer portion of the shoe upper also allow the user to slide his or her foot along a skate griptape without lifting and separating the strap 20 from the shoe upper. This provides a smooth sliding interface moving outwards to inwards along the shoe upper to allow the user to slide the shoe upper against the skate with ease and minimal interference. Further still, the upper edges 22 of the shoe upper are adapted to extend above the shoelace eyelets, which are positioned along an inner tab or ledge region under the upper edges 22. The eyelet tabs are secured along the inner surface of the shoe upper such that the extended upper edge 22 forms over the top surface of the outer tongue 17 when in a secured position. This transition provides a transition from the shoe upper 12 to the outer tongue 17 with minimal gaps or discontinuities that could create a snag risk.

Figure 2:
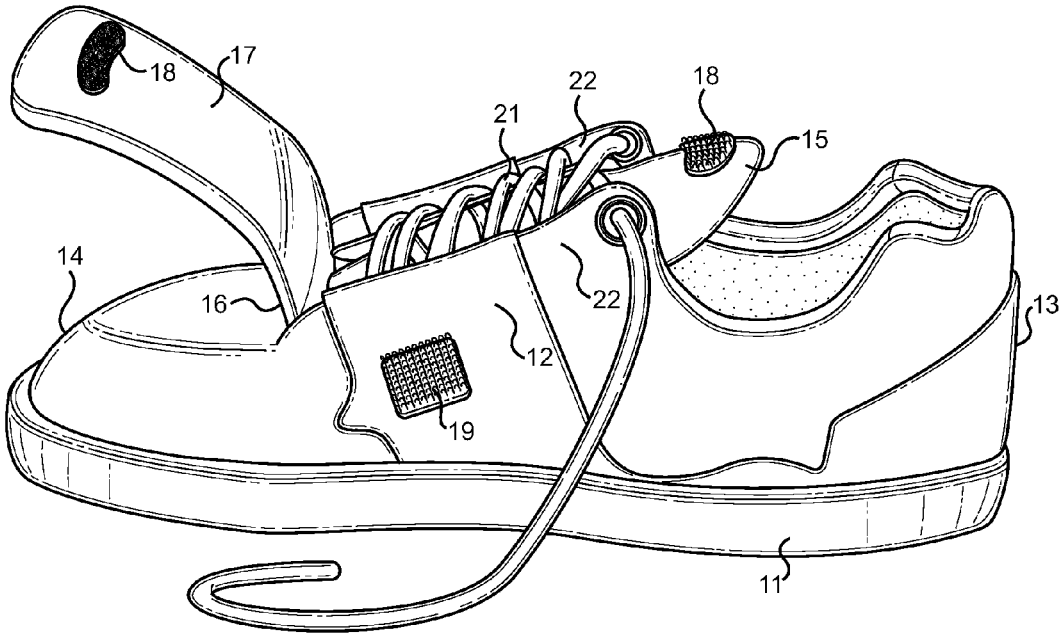
FIG. 2 is a side view of the present invention in an open configuration.

Referring now to FIG. 2, there is shown a side view of the present invention in an open configuration, whereby the elements of the assembly are readily visualized from the interior side of the shoe. Along the interior portion of the shoe upper 12, the strap distal end connector element 19 is positioned, providing a means to secure the strap over the outer tongue 17 when the outer tongue 17 is secured 18 over the shoelaces 21. The shoe upper 12 extends upward and terminates along an upper edge 22 above the woven shoelaces 21 within their supporting eyelets, whereby the upper edge 22 is adapted to conform over the outer tongue 17 when in a working state. This transition between the shoe upper 12 and the outer tongue 18 prevents snagging and offers a smooth sliding interface for which the wearer to engage a skateboard griptape, while the strap provides a laterally extending member that prevents the outer tongue 18 from disconnected from its connector 18 along the inner tongue 15. The upper two eyelets of the shoelaces may be disposed along the upper portion of the shoe upper and not along the inner elongated tab, as shown in the figures. This provides more ready access to the free ends of the laces for tying a knot and securing the shoelaces. The design of the shoe, notably the sole 11, the heel 13, toe cap 14, and upper region 12 may be specific to a brand or a given style, while the present invention is positioned thereabove to protect and shroud the woven laces 21 of the shoe.

Figure 3:
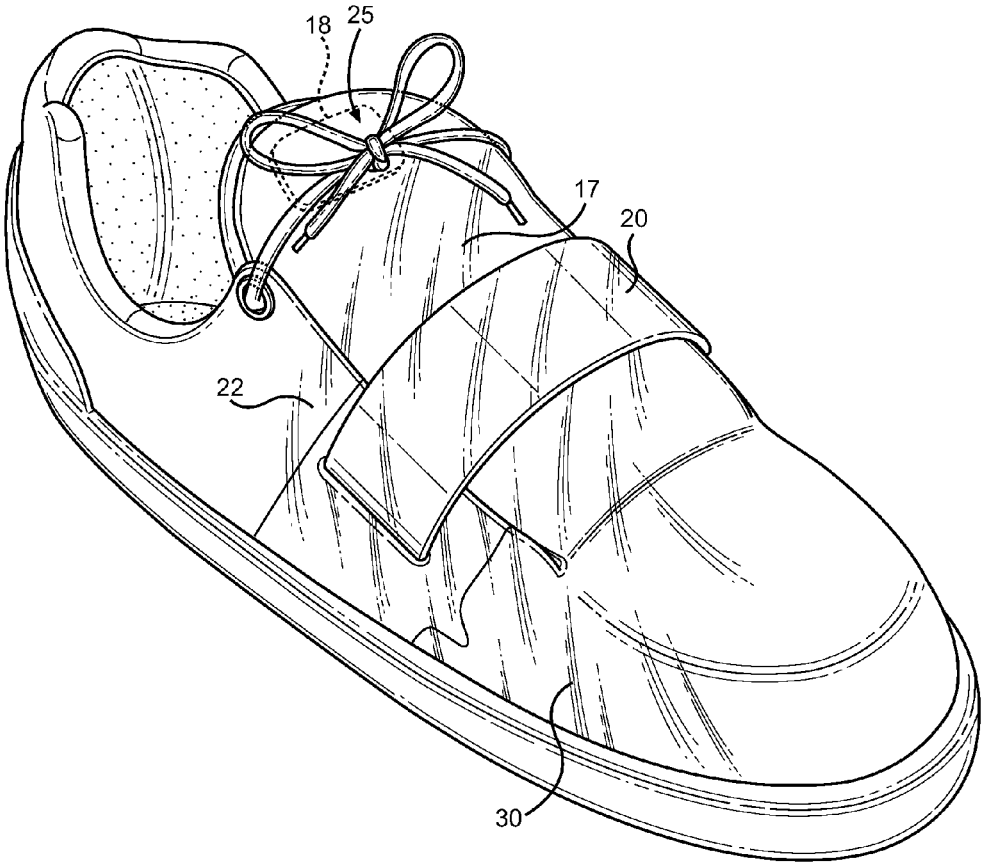
FIG. 3 is a view of the present skate shoe in a secured and working state, ready for skateboarding use or for casual wear.

Referring now to FIG. 3, there is shown a view of the skate shoe of the present invention in a secured and working position, whereby the outer tongue 17 is secured 18 to the inner tongue while the outer strap 20 is secured laterally over the outer tongue 17. The upper edge 22 of the shoe upper conceals the side edges of the outer tongue 17, whereby the edges 22 conform over the outer tongue 17 to make a smooth transition between the shoe upper and the outer tongue. The shoe laces can then be tied into a knot 25 under the outer tongue 17 or thereover, depending on the access needs and tastes of the wearer. In use, the outer tongue 17, upper edge 22 of the shoe upper, and the laterally inward-directed strap 20 provide a relatively clean interface for which to slide against a skateboard surface. Wear 30 to the shoe is contained to the outer material of the shoe upper, the outer tongue 17, and the strap 20, while the shoelaces are prevented from contact with the skateboard. In this way, the laces are not exposed to continual abrasive contact and high friction surfaces that create fraying, wear, and eventual failure of the lace structure. Preventing the laces from wearing prematurely prevents the wearer from stepping out of his or her shoe during a skateboarding activity, while also reduces the cost of the shoe maintenance by preventing an otherwise higher frequency of lace replacement that is common with most skate shoes.

It is common occurrence in the world of skateboarding the skate shoe laces fail frequently when exposed to skateboarding activity for prolonged periods. The wear of the skateboard griptape and the outdoor environment causes the structure of the laces to rip, fray, and eventually fail. This can cause the skateboarder to trip and fall, thus creating a risk to the wearer. The present invention provides a shroud and protective cover over the skate shoe laces while skateboarding, prolonging the overall life of the laces and shoe. The structure facilitates smooth sliding of the skate shoe upper along the surface of the griptape, facilitating skateboarding trips and eliminating the fear of damaging the laces in the process. It is contemplated that the present skate shoe structure be ideal for anyone learning how to or regularly using a skateboard, including kids, teenagers, and adults of all skill levels.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoelace protecting skate shoe having a continuous sliding upper interface, comprising:

a shoe sole connecting to a shoe upper having a shoe opening and shoe laces securing over said shoe opening;

said laces supported within eyelets, said eyelets be disposed along elongated tabs within said opening and along and inner surface of said shoe upper;

an inner tongue and an outer tongue pivotably attached to a shoe throat line along said shoe upper, said throat line positioned adjacent to said shoe upper to cap;

said outer tongue and said inner tongue having a distal end and a complimentary connector element theredisposed for securing said inner and outer tongue together;

said shoe upper having an upper edge extending above said eyelet tab so as to form over said outer tongue when said outer tongue is secured to said inner tongue;

a lateral strap connected to an outer portion of said shoe upper and extending over said shoe upper edge and said outer tongue when said outer and inner tongues are connected;

a strap connector element for securing a distal end of said strap along said shoe upper inner portion.

2. The device of claim 1, wherein said strap connector element of said strap is patch of hook and loop fastener material.

3. The device of claim 1, wherein said complimentary connector element of said inner and outer tongue is patch of hook and loop fastener material.

* * * * *